US005789131A

United States Patent [19]

Mikuriya et al.

[11] Patent Number: 5,789,131

[45] Date of Patent: Aug. 4, 1998

[54] DEVELOPER FOR DEVELOPING ELECTROSTATIC LATENT IMAGE

[75] Inventors: Yoshihiro Mikuriya, Amagasaki; Yoshikazu Nishihara, Itami; Hiroyuki Fukuda, Kobe, all of Japan

[73] Assignee: Minolta Co., Ltd., Osaka, Japan

[21] Appl. No.: 856,602

[22] Filed: May 15, 1997

Related U.S. Application Data

[63] Continuation of Ser. No. 579,147, Dec. 27, 1995, abandoned.

[30] Foreign Application Priority Data

| | | | |
|---|---|---|---|
| Dec. 28, 1994 | [JP] | Japan | 6-326867 |
| Dec. 28, 1994 | [JP] | Japan | 6-326969 |
| Mar. 6, 1995 | [JP] | Japan | 7-045385 |

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,486,524 | 12/1984 | Fujisaki et al. | 430/109 |
| 4,640,882 | 2/1987 | Mitsuhashi et al. | 430/110 |
| 4,939,060 | 7/1990 | Tomiyama et al. | 430/106.6 |
| 5,024,915 | 6/1991 | Sato et al. | 430/110 |
| 5,026,620 | 6/1991 | Masaki et al. | 430/111 |
| 5,106,715 | 4/1992 | Matsumura et al. | 430/110 |

FOREIGN PATENT DOCUMENTS

| | | |
|---|---|---|
| 59-90858 | 5/1984 | Japan . |

*Primary Examiner*—Roland Martin

[57] ABSTRACT

A developer for developing an electrostatic latent image comprising: (a) a positively chargeable toner particle comprising a binder resin which comprises a styrene-type copolymer having an acid value of 1 to 10 KOHmg/g and a colorant; and (b) a hydrophobic silica adhered to the surface of said toner particle, said hydrophobic silica being treated by a hydrophobic property imparting agent and having a pH of 6.5 to 9.0.

36 Claims, 1 Drawing Sheet

DEVELOPER FOR DEVELOPING ELECTROSTATIC LATENT IMAGE

This is a continuation of application Ser. No. 08/579,147, Dec. 27, 1995, now abandoned.

BACKGROUND OF THE INVENTION

1. Field of the Invention

The present invention relates to a developer for developing electrostatic latent images by electrophotography, electrostatic recording, electrostatic printing and the like. More specifically, the present invention relates to a developer containing a positively chargeable toner.

2. Description of the Related Art

In electrophotography, electrostatic recording, electrostatic printing and the like, an electrostatic latent image formed on a latent image-bearing member is electrostatically developed by a charged toner. After development, the toner image is transferred from the latent image-bearing member to a transfer sheet, whereupon the image is fixed thereon by fusing.

In recent years, particularly in image forming apparatus such as electrophotographic copying machines and the like, there has developed a demand for developer containing toner having excellent fixing characteristics with respect to higher speed image formation and low-temperature fixing in view of energy conservation.

One method for improving fixing characteristics considered using a low-molecular weight binder resin in the toner. When only a low-molecular weight resin is used as the binder, however, and particularly when used after storage under high temperature conditions, the amount of toner charge decays from the initially set value, and as a result various disadvantages occur including increased toner airborne dispersion causing background fog and soiling of the white portion of the paper, as well as toner soiling around the periphery of the developing device. Furthermore, the characteristics of the developer are changed by toner solidification and the like.

These disadvantages become pronounced when a developer containing a positively charging toner is used for normal developing of a negative charged electrostatic latent image formed on a latent image-bearing member such as an organic photosensitive member or the like, or when used for reverse developing of a positive charged electrostatic latent image formed on a latent image-bearing member such as an amorphous silicon photosensitive member or the like.

There is, therefore, demand for a developer containing a toner which does not exhibit marked decay of the amount of charge or change due to solidification and the like due to environmental fluctuation, e.g., temperature changes, and which does not exhibit a change in the amount of charge over time.

SUMMARY OF THE INVENTION

An object of the present invention is to provide a developer for developing electrostatic latent images which satisfies the previously mentioned demands.

Another object of the present invention is to provide a developer for developing electrostatic latent images which has excellent environmental stability.

Another object of the present invention is to provide a developer for developing electrostatic latent images which has excellent charging characteristics.

Yet another object of the present invention is to provide a developer for developing electrostatic latent images which has excellent fixing characteristics.

A further object of the present invention is to provide a developer for developing electrostatic latent images which is capable of forming sharp developed images without fog and the like even in high-speed copying.

A still further object of the present invention is to provide a developer for developing electrostatic latent images which contains an excellent positively chargeable toner.

These and other objects, advantages and features of the invention will become apparent from the following description thereof taken in conjunction with the accompanying drawing.

DESCRIPTION OF THE PREFERRED EMBODIMENT

Figure 1:
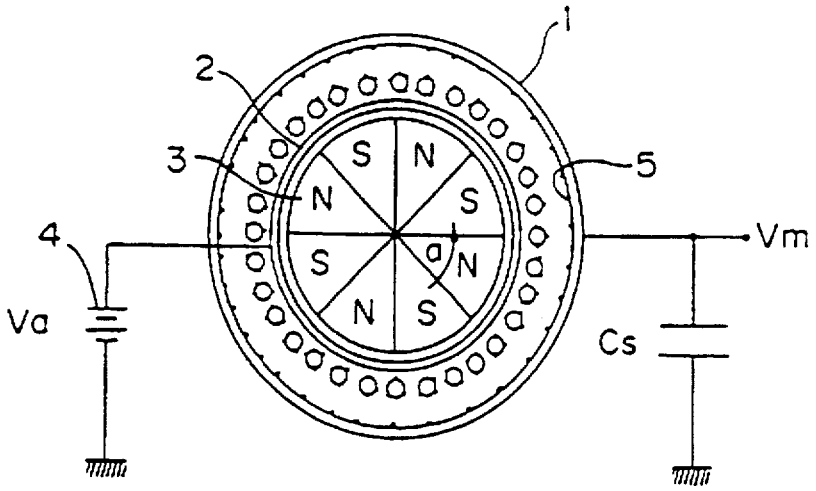
FIG. 1 shows a charge measuring device.

The preferred embodiment of the present invention is a developer for developing electrostatic latent images which includes toner particles containing colorant and styrene-type copolymer, and hydrophobic silica microparticles having a predetermined pH value externally added to the toner particles as a post-process agent.

The pH of the hydrophobic silica microparticles is desirably 6.5 to 9.0, and preferably 7.5 to 8.5. When material having a pH of less than 6.5 is used, negative charging characteristics are apt to be enhanced so as to generate an oppositely charge component, thereby preventing effective elimination of the disadvantages such as fogging after storage under high temperature. The upper limit of pH is set at 9.0 due to difficulty in manufacturing. Silica which has been subjected to hydrophobic treatment by hydrophobic property-imparting agent such as dimethyldichlorosilane and the like typically has a pH of 3 to 6.

In order to obtain the above-mentioned silica microparticles, silica microparticles may be subjected to surface treatment using at least a hydrophobic property-imparting agent. In addition to the aforesaid hydrophobic property-imparting agent, silica microparticles may also be subjected to surface processing using amino-type surface treatment agent such as amino-type coupling agents or aminosilicone oil.

Organosilicic compounds may be used as hydrophobic property-imparting agents. Examples of useful organosilicic compounds include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichloro silane, ρ-chloroethyltrichlorosilane, chloromethyldimethyl chlorosilane, triorganosilylmercaptan, trimethylsilylmercaptan, trioragnosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane containing a hydroxide group bonded to Si atom in units positioned at a terminus and having two to twelve siloxane units per molecule. These organosilicic compounds may be reacted with or physically absorbed by silica microparticles. These compounds may be used individually or in combinations of two or more types.

The amino-type coupling agents will preferably have the structural formulae shown in the examples below.

$H_2NCH_2CH_2CH_2Si(OCH_3)_3$
$H_2NCH_2CH_2CH_2Si(OC_2H_5)_3$ $H_2NCH_2CH_2CH_2Si(CH_3)(OCH_3)_2$ $H_2NCH_2CH_2NHCH_2CH_2CH_2Si(CH_3)(OCH_3)_2$ $H_2NCONHCH_2CH_2CH_2Si(OC_2H_5)_3$
$H_2NCH_2CH_2NHCH_2CH_2CH_2Si(OCH_3)_3$
$H_2NCH_2CH_2NHCH_2CH_2NHCH_2CH_2CH_2Si(OCH_3)_3$
$H_5C_2OCOCH_2CH_2NHCH_2CH_2CH_2Si(OCH_3)_3$
$H_5C_2OCOCH_2CH_2NHOH_2CH_2NHCH_2CH_2CH_2Si(OCH_3)_3$
$H_5C_2OCOCH_2CH_2NHCH_2CH_2NHCH_2CH_2NHCH_2CH_2NHCH_2CH_2CH_2Si(OCH_3)_3$
$H_3COCOCH_2CH_2NHCH_2CH_2NHCH_2CH_2CH_2Si(OCH_3)_3$

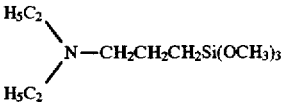

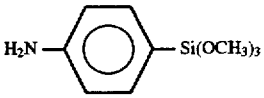

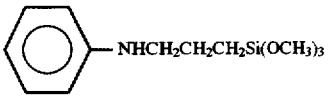

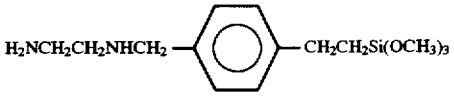

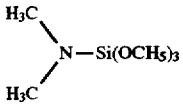

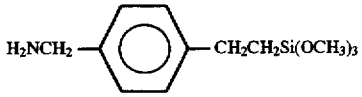

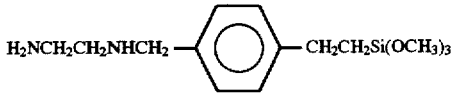

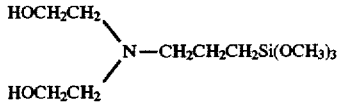

$(H_3CO)_3SiCH_2CH_2CH_2-NHCH_2$

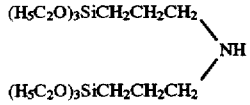

$H_3CNHCH_2CH_2CH_2Si(OC_2H_5)_3$
$H_2N(CH_2CH_2NH)_2CH_2CH_2CH_2Si(OCH_3)_3$
$H_3C-NHCONHC_3H_5Si(OCH_3)_3$

A variety of conventional surface processing methods may be used for the surface treatment of the silica microparticles. For example, the silica microparticles may be chemically treated by the organosilicic compounds so as to be rendered hydrophobic. It is desirable that silica microparticles produced by vapor phase oxidation of silicon halogenides are first treated by amino-type coupling agent, and thereafter treated by organosilicic compounds. Alternatively, a method may be used wherein treatment by organosilicic compound occurs simultaneously with treatment by amino-type coupling agent.

The ratio of amino-type coupling agent and hydrophobic property-imparting agent used in the surface processing of the silica microparticles is desirably a weight ratio of 3:1 to 1:5, more desirably 3:1 to 1:3, preferably 2:1 to 1:4.5, and ideally 2:1 to 1:2.

The total amount of amino-type coupling agent and hydrophobic property-imparting agent is desirably 5 to 20 percent-by-weight, and preferably 10 to 15 percent-by-weight, with respect to the inorganic microparticles.

The pH of the silica microparticles may be measured by suspending the silica microparticles in a solvent mix comprising an organic solvent (methanol, acetone or the like) and water, and measuring the pH with a pH meter.

From the standpoint of improving environmental stability of the toner chargeability, and particularly in improving stability with respect to temperature fluctuations, the hydrophobic silica microparticles will desirably have a hydrophobicity of 55 or greater, and preferably 55 to 85, and ideally 60 to 85. When the hydrophobicity is less than 55, charge leakage caused by external air temperature fluctuations may increase, thereby adversely affecting the environmental stability of the toner charge.

Hydrophobicity is measured by a methanol test titration. The specific method of the methanol test titration involves introducing 50 cc distilled water in a 200 cc beaker, then adding 0.2 g of silica microparticles. Methanol is titrated in while the solution is mixed, and when the silica microparticles are completely wetted the percentage of methanol in the aqueous solution is determined to express the degree of hydrophobicity.

The hydrophobic silica microparticles are desirably added in a rate of 0.05 to 0.3 parts-by-weight, and preferably 0.1 to 0.2 parts-by-weight, with respect to 100 parts-by-weight toner particles. The method of adding the hydrophobic silica microparticles to the exterior of the toner particles may be any of various common methods insofar as the silica particles are mixed with said particles. When the amount of added silica microparticles is less than 0.05 parts-by-weight, the beneficial effects of said addition may be negligible, and flow characteristics may be reduced. When the amount of added silica microparticles is greater than 0.3 parts-by-weight, it may cause increased spent of the carrier and reduced developer durability.

Styrene-type polymers, and particularly styrene-type copolymers such as styrene-acrylic type copolymers which comprises styrene-type monomer and another comonomer, may be used as the binder resin. Examples of useful styrene-type monomers which constitute styrene-type copolymers include styrene-type monomers such as styrene, α-methylstyrene, p-methylstyrene, p-tert-butylstyrene, p-chlorostyrene and the like, and derivatives thereof.

Examples of useful comonomer components copolymerized with the styrene-type monomers include vinyl-type monomers such as methacrylate-type monomers, acrylate-type monomers, acrylonitrile, maleic acid, maleic acid esters, vinylchloride, vinyl acetate, vinyl benzoate, vinylmethylethyl ketone, vinylhexyl ketone, vinylmethyl ether, vinylethyl ether and vinylisobutyl ether and the like.

Examples of the methacrylate-type monomers include methacrylic acid, methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate and the like.

Examples of the acrylate-type monomers include acrylic acid, methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl) butyl acrylate, hexyl acrylate, octyl acrylate, nonyl acrylate, decyl acrylate, undecyl acrylate, and dodecyl acrylate and the like.

It is particularly desirable to use unsaturated carboxylic acid such as acrylic acid, methacrylic acid or the like as an indispensable monomer in order to regulate the acid value of the resins as described below.

The acid value of the styrene-type copolymer of the binder resin is desirably 1 to 10.0 KOHmg/g, and preferably 3 to 10 KOHmg/g. The acid value of the styrene-type copolymer may be regulated, for example, by adjusting the amount of comonomer such as methacrylic acid, acrylic acid and the like.

External addition of above-mentioned post-process agent having a predetermined pH value to the toner containing binder resin having a suitable acid value improve dispersion characteristics of both materials, reduce image fogging and stabilize the charge amount by preventing dissociation of the post-process agents.

When the acid value of the binder resin is less than 1 KOHmg/g, not only may be there inadequate separation preventing effectiveness of the post-process agent, but there may be also inadequate charge stabilization inasmuch as there is concern the toner charge will be readily increased. When the acid value of the binder resin is greater than 10.0 KOHmg/g, the amount of the toner charge may be reduced, as may be environmental stability.

The molecular weight of the binder resin may be adjusted so as to have a typically used value; a low-molecular weight resin may be used, or used in combination with a high-molecular weight resin in accordance with high-speed copying.

For example, a binder resin may be used which comprises a combination of 30 to 70 parts-by-weight styrene-type copolymer having a number-average molecular weight in the range of 2,000~20,000, and preferably within the range of 3,000~15,000, and 70 to 30 parts-by-weight of styrene-type copolymer having a number-average molecular weight within a range of 50,000~500,000, and preferably within a range of 100,000~400,000.

Use of a low-molecular weight styrene-type copolymer resin having a number-average molecular weight of 2,000~20,000 (hereinafter referred to as "low-molecular weight binder resin") is effective in improving fixing characteristics and fixing strength. When the molecular weight of the low-molecular weight binder resin is less than 2,000, toner flocculation is apt to occur, and developer fluidity may be reduced, whereas fixing strength may be reduced when the molecular weight exceeds 20,000.

The high-molecular weight styrene-type copolymer having a number-average molecular weight of 50,000~500,000 (hereinafter referred to as "high-molecular weight binder resin") is effective in assuring the anti-offset range and improving the prevention of wrapping around the fixing roller. When the molecular weight of the high-molecular weight binder resin is less than 50,000, the high-temperature anti-offset range may be narrowed. When the molecular weight exceeds 500,000, the low-temperature anti-offset range may be narrowed.

The number-average molecular weights of styrene-type copolymers can be calculated as a molecular weight at the position of peak in a molecular weight distribution measured by gel permeation chromatography (GPC).

When ratio of the low-molecular weight binder resin and high-molecular weight binder resin is suitably selected in accordance with the characteristics demanded of the toner, e.g., fixing temperature, copying speed, copying method, manufacturing characteristics and the like. This ratio is desirably selected from a range of 3/7 to 7/3 (low-molecular weight component/high-molecular weight component). A ratio of 4/6 to 6/4 is desirable as being suitable for its high-temperature storage characteristics and effectiveness with respect to excellent fixing characteristics in high-speed copying. When this ratio departs from the aforesaid range and there is excessive low-molecular weight binder resin, there is concern the toner will become unsafe with increased powdering during manufacture, thereby reducing the toner yield. When there is excessive high-molecular weight binder resin, there is concern that fixing characteristics will be adversely affected with respect to high-speed copying, and toner manufacturing characteristics may be adversely affected by pulverization methods.

Carbon black can be uniformly dispersed in the binder resin by setting the pH of the carbon black to be added to the binder resin at 2~5, and preferably 2~3. The dispersability of the toner particles and silica particles can be improved by giving a predetermined pH to the silica particles added to as previously described. Using the aforesaid pH relationship of the silica particles and carbon black function to effectively prevent separation of the silica particles during copying, thereby preventing toner airborne dispersion and allowing formation of excellent images without fogging or the like. When the pH of the carbon black is less than 2, there is concern about reduction of the toner charge. When the pH exceeds 7, there is concern about inadequate effectiveness in preventing separation of the silica particles.

It is desirable, from the perspectives of dispersability and degree of black coloration, that the carbon black is added at a rate of 7~15 parts-by-weight, and preferably 10~15 parts-by-weight, with respect to 100 parts-by-weight binder resin. When the amount of added carbon black is less than 7 parts-by-weight, the effectiveness of preventing separation of the silica particles may be lost, and there is concern adequate degree of black coloration will not be obtained. When the added amount of carbon black exceeds 15 parts-by-weight, not only may be dispersability reduced, but there is also concern of a reduction of toner charge.

The synthesis of styrene-type copolymers using the previously mentioned monomers may be accomplished by normal methods, e.g., radical polymerization, suspension polymerization, emulsion polymerization, solution polymerization, bulk polymerization and the like. Desired values of styrene-type copolymer molecular weight can be obtained by changing conditions such as polymerization time, kinds of molecular weight-controlling agents and the like. Examples of useful molecular weight-controlling agents include mercaptans such as lauryl mercaptan, phenyl mercaptan, butyl mercaptan, dodecyl mercaptan and the like, and halogenated carbons such as carbon tetra chloride, carbon tetrafluoride and the like.

Toner particles may contain negatively chargeable polyolefin wax. The negatively chargeable wax means a wax which shows negative charge by mixing with the carrier. The negatively chargeable polyolefin wax is desirably a wax having a charge of −30 μC/g to −10 μC/g, and preferably −25 μC/g to −15 μC/g, and polyethylene-type waxes, and Fishcer-Tropsch waxes are particularly desirable. Addition of the negatively chargeable polyolefin wax strongly adheres the fluidizing agent (silica microparticles) to the toner, and eliminates the problems of said fluidizing agent separating from the toner and adhering to the photosensitive member (filming), and prevents black dot image defects in the non-image region. When the amount of charge is less than −30 μC/g, the positive chargeability of the toner may be adversely affected, whereas when the amount of charge is greater than −10 μC/g, the dispersability of the fluidizing agent may be reduced.

The amount of charge of the wax is expressed as a value measured by the blow-off method, i.e., by pulverizing the raw material wax to about 10 μm, manually shaking 30 g iron powder (Z-150/250 Powder Tech) carrier and 30 mg pulverized wax, and thereafter using a blow-off powder charge measuring device (Toshiba Chemical, Ltd.) to measure the charge.

The negatively chargeable polyolefin wax is desirably added at a rate of 0.5 to 5.0 parts-by-weight, and preferably 1.0 to 3.0 parts-by-weight with respect to 100 parts-by-weight of binder resin. When the added amount is less than 0.5 parts-by-weight, separation of the fluidizing agent from the toner may not be effectively prevented, and there is concern that wear resistance cannot be improved. When added amount is greater than 5.0 parts-by-weight, heat resistance may be reduced, and powder characteristics may be reduced.

A charge controlling agent (e.g., positive charge controlling agents such as nigrosine-type, triphenyl methane-type or the like), resin beads as cleaning agents (e.g., teflon, polyethylene, silicone, styrene resin, acrylic resin and the like) may be added to the developer as necessary. The obtained developer is suitable for any developing method capable of using positive chargeability, and is capable of excellent environmental stability, charge stability, and forming images of excellent quality without fogging or the like.

The mean particle size of the toner particles is preferably 6~12 μm, and ideally 7~9 μm.

The charging member used to charge the toner particles contained in the developer may be a conventional charging member inasmuch as the toner particles are triboelectrically charged with a positive charge. When the aforesaid developer is used as a two-component developer, the toner may be positively charged via friction induced by mixing the toner and carrier particles.

The present invention is described below by way of experimental examples.

Production of Silica Microparticles A

Under a nitrogen atmosphere, 100 g of silica (lot #200; Degussa Ltd.) were introduced into a flask and while the material was being uniformly mixed, 4 g of aminosilane and 6 g of hexamethyldisilazane were introduced by spray injection and refluxed for 2 hr at 140° C., then dried. After cooling, silica microparticles A (pH 8.5, hydrophobicity 60) were obtained.

Production of Silica Microparticles B

Silica microparticles B (pH 7.5, hydrophobicity 80) were produced by the same method as silica microparticles A with the exception that 10 g of hexamethyldisilazane was substituted for the 6 g of hexamethyldisilazane.

Production of Silica Microparticles C

Silica microparticles C (pH 4, hydrophobicity 40) were produced by the same method as silica microparticles A with the exception that 10 g of dimethyldichlorosilane was substituted for the 6 g of hexamethyldisilazane.

Production of Silica Microparticles D

Silica microparticles D (pH 5.5, hydrophobicity 50) were produced by the same method as silica microparticles A with the exception that 10 g of octyltrimethoxysilane was substituted for the 6 g of hexamethyldisilazane.

The pH of silica microparticles A~D are values measured by pH meter when 4 parts-by-weight of silica microparticles were suspended in 96 parts-by-weight mixed solvent of water and acetone (1:1).

Experimental Example 1

| | Parts-by-weight |
|---|---|
| * Thermoplastic styrene-acrylic type resin (acid value: 5 KOH mg/g, Tg: 60° C., Mn: 4,000, Mw: 200,000, copolymerization ratio: styrene/butyl acrylate/butyl methacrylate/methacrylic acid = 70/14/14/2) | 100 |
| * Carbon black (Mogul L; Cabot Ltd.) | 10 |
| * Nigrosine pigment (Nigrosine Base EX; Oriental Chemicals K.K.) | 5 |
| *Polypropylene wax (Biscol 550P; Sanyo Kasei K.K.) | 5 |

These materials were uniformly mixed using a henschel mixer, then kneaded via continuous extrusion using a model PCM30 (1/d=32.5). After cooling, the kneaded material was coarsely pulverized using a feather mill. The coarsely pulverized material was finely pulverized using a mechanical pulverizer (Cryptron KTM-O; Kawasaki Heavy Jyu-Kogyo K. K.). The finely pulverized material was classified by air classifier, then classified by a mechanical type classifying device (50ATP classifier; Hosokawa Micron K. K.) to obtain fine particles having a mean particle size of 11 μm. To these fine particles were added 0.2 percent-by-weight silica microparticles A (pH 8.5, hydrophobicity 60) in an additive mixing process to obtain developer 1.

In the specification, "Mn" means number-average molecular weight and "Mw" means weight-average molecular weight.

Experimental Example 2

Developer 2 was produced in the same manner as experimental example 1 with the exception that silica microparticles B (pH 7.5, hydrophobicity 80) were substituted for silica microparticles A.

Experimental Example 3

Developer 3 was produced in the same manner as experimental example 1 with the exception that 7 parts-by-weight of Carbon black #50 (Mitsubishi Kasei K. K.) were substituted for the 10 g Mogul L.

Experimental Example 4

Developer 4 was produced in the same manner as experimental example 1 with the exception that styrene-acrylic type resin having an acid value 10 KOHmg/g and Tg of 58° C. (Mn: 4,500, Mw: 250,000, copolymerization ratio: styrene/butyl acrylate/butyl methacrylate/methacrylic acid= 60/19/18/3) was used as the binder resin.

Experimental Example 5

Developer 5 was produced in the same manner as experimental example 3 with the exception that styrene-acrylic type resin having an acid value of zero and Tg of 57° C. (Mn: 5,000, Mw: 300,000, copolymerization ratio: styrene/butyl acrylate/butyl methacrylate=70/15/15) was used as the binder resin.

Experimental Example 6

Developer 6 was produced in the same manner as experimental example 1 with the exception that silica microparticles D (pH 5.5, hydrophobicity 50) was substituted for silica microparticles A.

Experimental Example 7

Developer 7 was produced in the same manner as experimental example 3 with the exception that styrene-acrylic type resin having an acid value of 30 KOHmg/g and Tg of 60° C. (Mn: 4,000, Mw: 250,000, copolymerization ratio: styrene/butyl acrylate/butyl methacrylate/methacrylic acid= 60/15/15/10) was used as the binder resin.

Experimental Example 8

Developer 8 was produced in the same manner as experimental example 1 with the exception that silica microparticles C (pH 4.0, hydrophobicity 40) were substituted for silica microparticles A.

Experimental Example 9

Developer 9 was produced in the same manner as experimental example 1 with the exception that silica microparticles C (pH 4.0, hydrophobicity 40) was substituted for silica microparticles A, and the methacrylic acid content of the styrene-acrylic type resin was adjusted to a zero acid value of the styrene-acrylic type resin.

Experimental Example 10

Developer 10 was produced in the same manner as experimental example 1 with the exception that silica microparticles C (pH 4.0, hydrophobicity 40) was substituted for silica microparticles A, and the methacrylic acid content of the styrene-acrylic type resin was adjusted to 30 KOHmg/g acid value of the styrene-acrylic type resin.

Evaluations

The developers obtained in the experimental examples 1~10 were evaluated for environmental resistance, fog, spotting and filming as described below.

(1) Environmental Resistance

The developers were loaded in an electrophotographic copying machine (model EP9765; Minolta Co., Ltd.), and used under high temperature high humidity environmental conditions (30° C., 85%) and low temperature low humidity environmental conditions (10° C., 15%). The toner charges at these times were measured and the difference between them ranked as indicated below.

○: Less than ±2.5 μC/g

Δ: ±2.5 μC/g or higher but less than 5.0 μC/g

X: ±5.0 μC/g or higher

The measurement of the toner charge (average charge amount) was accomplished under the conditions described below using the device shown in FIG. 1.

(a) Setting the speed of a magnet roller 3 at 500 rpm.

(b) Measuring a total of 1 g of developer using a precision balance scale.

(c) Uniformly dispersing the developer on the surface of a conductive developing sleeve 2.

(d) Applying a bias voltage of 2 kV opposite the charge potential of the developer by a bias power source 4.

(e) Rotating the sleeve for 60 sec, and reading the potential at the time the sleeve is stopped.

(f) The amount of toner 5 adhered to a cylindrical electrode 1 at this time is measured by precision balance scale, to determine the average toner charge.

(2) Fog

The developers were stored for 24 hr at 50° C., then used to print 5,000 sheets using a model EP9765 copying machine (Minolta Co., Ltd.; copy speed: 76 pages/min). After 5,000 printings, the copy images were evaluated for fogging, and ranked as indicated below.

○: No fogging observed

Δ: Slight fogging observed

X: Severe fogging observed

Although rankings of ○ and Δ indicate the developer is usable for practical purposes, a ranking of ○ indicates the developer is desirable, and a ranking of X indicates the developer is unusable in practice.

(3) Spotting

The developers were stored for 24 hr at 50° C., then used to print 5,000 sheets using a model EP8605 copying machine (Minolta Co., Ltd.; copy speed: 60 pages/min). After 5,000 printings, the copy images were visually examined and evaluated for spotting of the copy image by black dots, and ranked as indicated below.

○: No spotting observed

Δ: Slight spotting observed

X: Severe spotting observed

Although rankings of ○ and Δ indicate the developer is usable for practical purposes, a ranking of ○ indicates the developer is desirable, and a ranking of X indicates the developer is unusable in practice.

(4) Filming

After fogging evaluation, the photosensitive member in the copying machine was visually examined for filming after 5,000 printings, and ranked as indicated below.

○: No filming observed

Δ: Slight filming observed

X: Severe filming observed

Although rankings of ○ and Δ indicate the developer is usable for practical purposes, a ranking of ○ indicates the developer is desirable, and a ranking of X indicates the developer is unusable in practice.

Evaluation results are shown in Table 1.

TABLE 1

| | Resin | Post-process Agent | | Environ- | | | |
|---|---|---|---|---|---|---|---|
| | Acid value | pH | Hydro-phobicity | mental resistance | Fog | Spotting | Filming |
| Ex. 1 | 5 | 8.5 | 60 | Δ | ○ | ○ | ○ |
| Ex. 2 | 5 | 7.5 | 80 | ○ | Δ | ○ | ○ |
| Ex. 3 | 5 | 8.5 | 60 | Δ | Δ | Δ | Δ |
| Ex. 4 | 10 | 8.5 | 60 | Δ | ○ | ○ | Δ |
| Ex. 5 | 0 | 8.5 | 60 | Δ | x | Δ | Δ |
| Ex. 6 | 5 | 5.5 | 50 | x | x | Δ | ○ |
| Ex. 7 | 30 | 8.5 | 60 | Δ | x | x | ○ |
| Ex. 8 | 5 | 4.0 | 40 | x | x | Δ | ○ |
| Ex. 9 | 0 | 4.0 | 40 | x | x | Δ | x |
| Ex. 10 | 30 | 4.0 | 40 | x | x | x | x |

Production of Silica Microparticles E

A sample of 500 ml special grade methanol (Wako Jyn-yaku Kogyo K. K.) was introduced into a flask, and 3 g of amino-type coupling agent (n-aminoethyl) aminopropylmethoxysilane and 3 g of hexamethyldisilazane (n-hexane solution), and the materials were thoroughly mixed and completely dissolved. To this solution was added 60 g of silica (Aerosil #200; Nippon Aerosil K. K.), and after thorough suspension the reaction solution was heated to 80° C. to remove the methanol and water formed by the reaction. The residue was dried and stored in a desiccator (drying agent: silica gel), to obtain positively chargeable silica microparticles E (pH 8.0, hydrophobicity 63).

Production of Silica Microparticles F

Positively chargeable silica microparticles F (pH 9.4, hydrophobicity 35) were produced in the same manner silica microparticles E with the exception that 5 g of aminopropylmethoxy silane were substituted for the 3 g of aminopropylmethoxysilane and 3 g of hexamethyldisilazane.

Production of Silica Microparticles G

Positively chargeable silica microparticles G (pH 8.7, hydrophobicity 73) were produced in the same manner silica microparticles E with the exception that 4 g of aminopropylmethoxy silane and 4 g of hexamethyldisilazane were substituted for the 3 g of aminopropylmethoxysilane and 3 g of hexamethyldisilazane.

Production of Silica Microparticles H

Positively chargeable silica microparticles H (pH 7.5, hydrophobicity 77) were produced in the same manner silica microparticles E with the exception that 2 g of aminopropylmethoxy silane and 3 g of hexamethyldisilazane were substituted for the 3 g of aminopropylmethoxysilane and 3 g of hexamethyldisilazane.

The pH values of silica microparticles E~H are values measured by pH meter when 4 parts-by-weight of the silica microparticle samples are suspended in 96 parts-by-weight of a solution mix comprising water and acetone (1:1).

Experimental Example 11

Using as the binder resin 50 parts-by-weight styrene-acrylic type copolymer (copolymerization ratio: styrene/butyl acrylate/butyl methacrylate/methacrylic acid=7/1.4/1.4/0.2; number-average molecular weight 5,000; acid value 6.5 KOHmg/g) and 50 parts-by-weight of styrene-acrylic type copolymer (copolymerization ratio: styrene/butyl acrylate/ butyl methacrylate/methacrylic acid=6/1.9/1.9/0.2; number-average molecular weight 200,000, acid value 6.5 KOHmg/g), 8 parts-by-weight carbon black (Mogul L; Cabot Ltd.) and 3 parts-by-weight high density polyethylene wax (Hiwax 800P; Mitsui Sekiyu Kagaku K. K.; wax blow-off charge −30 μC/g) were added to the binder resin and fusion kneaded. The kneaded material was pulverized and classified to obtain a powder having a mean particle size of 8 μm. To the obtained powder was added 0.2 percent-by-weight silica microparticles E (pH 8.0, hydrophobicity 63) in a additive process to obtain developer 11.

Experimental Example 12

Developer 12 was produced in the same manner as experimental example 11 with the exception that the binder resin comprising 40 parts-by-weight styrene-acrylic type copolymer having a number-average molecular weight of 15,000 (copolymerization ratio: styrene/butyl acrylate/butyl methacrylate/ methacrylic acid=7/1.4/1.4/0.2) and 60 parts-by-weight styrene-acrylic type copolymer having a number-average molecular weight of 350,000 (copolymerization ratio: styrene/butyl acrylate/butyl methacrylate/methacrylic acid=6/1.9/1.9/0.2) was substituted for the binder resin of experimental example 11, and silica microparticles G (pH 8.7, hydrophobicity 73) were substituted for silica microparticles E.

Experimental Example 13

Developer 13 was produced in the same manner as experimental example 11 with the exception that the binder resin comprising 60 parts-by-weight styrene-acrylic type copolymer having a number-average molecular weight of 10,000 (copolymerization ratio: styrene/butyl acrylate/butyl methacrylate/ methacrylic acid=7/1.4/1.4/0.2) and 40 parts-by-weight styrene-acrylic type copolymer having a number-average molecular weight 250,000 (copolymerization ratio: styrene/butyl acrylate/ butyl methacrylate/methacrylic acid= 6/1.9/1.9/0.2) was substituted for the binder resin of experimental example 11, and silica microparticles H (pH 7.5, hydrophobicity 77) were substituted for silica microparticles E.

Experimental Example 14

Developer 14 was produced in the same manner as experimental example 11 with the exception that polyethylene wax having a blow-off charge of −10 μC/g (Hiwax 400P; Mitsui Sekiyu Kagaku K. K.) was substituted for the polyethylene wax having a blow-off charge of −30 μC/g of experimental example 11.

Experimental Example 15

Developer 15 was produced in the same manner as experimental example 11 with the exception that the binder resin comprising 50 parts-by-weight styrene-acrylic type copolymer having a number-average molecular weight of 5,000 (copolymerization ratio: styrene/butyl acrylate/butyl methacrylate=7/1.5/1.5) and 50 parts-by-weight styrene-acrylic type copolymer having a number-average molecular weight of 200,000 (copolymerization ratio: styrene/butyl acrylate/butyl methacrylate=6/2/2) was substituted for the binder resin of experimental example 11, and 7 parts-by-weight Carbon Black #50 (Mitsubishi Kasei K. K.) was substituted for the 8 parts-by-weight Mogul L.

Experimental Example 16

Developer 16 was produced in the same manner as experimental example 15 with the exception that 3 parts-by-weight of polypropylene wax (Biscol 660P; Sanyo Kasei K. K.) was substituted for the polyethylene wax of experimental example 15.

Experimental Example 17

Developer 17 was produced in the same manner as experimental example 11 with the exception that Silica R974 (Nippon Aerosil K. K.; pH 4.5, hydrophobicity 35) was substituted for the silica microparticles E.

Experimental Example 18

Developer 18 was produced in the same manner as experimental example 11 with the exception that silica microparticles F (pH 9.4, hydrophobicity 35) was substituted for silica microparticles E.

Experimental Example 19

Developer 19 was produced in the same manner as experimental example 15 with the exception that the binder resin comprising 80 parts-by-weight styrene-acrylic type copolymer having a number-average molecular weight of 5,000 (copolymerization ratio: styrene/butyl acrylate/butyl methacrylate=7/1.5/1.5) and 20 parts-by-weight styrene-acrylic type copolymer having a number-average molecular weight of 100,000 (copolymerization ratio: styrene/butyl acrylate/butyl methacrylate=6/2/2) was substituted for the binder resin of experimental example 15.

Experimental Example 20

Developer 20 was produced in the same manner as experimental example 15 with the exception that the binder resin comprising 90 parts-by-weight styrene-acrylic type copolymer having a number-average molecular weight of 15,000 (copolymerization ratio: styrene/butyl acrylate/butyl methacrylate=7/1.5/1.5) and 10 parts-by-weight styrene-acrylic type copolymer having a number-average molecular weight of 350,000 (copolymerization ratio: styrene/butyl acrylate/butyl methacrylate=6/2/2) was substituted for the binder resin of experimental example 15.

In the experimental examples 11~20, the number-average molecular weight is expressed as the molecular weight at a position having a peak in a molecular weight distribution measured by gel permeation chromatography (GPC).

Evaluations

The developers of the experimental examples 11~20 were evaluated for fog, spotting, filming and wear resistance as described below.

(1) Fog

The developers were stored for 24 hr at 50° C., then used to print 5,000 sheets using a model EP9765 copying machine (Minolta Co., Ltd.; copy speed: 76 pages/min). After 50,000 printings, the copy images were evaluated for fogging, and ranked as indicated below.

○: No fogging observed

Δ: Slight fogging observed

X: Severe fogging observed

Although rankings of ○ and Δ indicate the developer is usable for practical purposes, a ranking of ○ indicates the developer is desirable, and a ranking of X indicates the developer is unusable in practice.

(2) Spotting

The developers were evaluated spotting by the previously described method.

(3) Filming

After fogging evaluation, the photosensitive member in the copying machine was visually examined for filming after 50,000 printings, and ranked as indicated below.

○: No filming observed

Δ: Slight filming observed

X: Severe filming observed

Although rankings of ○ and Δ indicate the developer is usable for practical purposes, a ranking of ○ indicates the developer is desirable, and a ranking of X indicates the developer is unusable in practice.

(4) Wear resistance

Images were produced using the developers in a model EP9765 copying machine (Minolta Co., Ltd.; copying speed 76 pages/min). The used copy sheet bearing copy image were rubbed with an unused copy sheet, and the degree of soiling of the unused copy sheet was evaluated, and ranked.

○: No soiling observed

Δ: Slight soiling observed

X: Severe soiling observed

Although rankings of ○ and Δ indicate the developer is usable for practical purposes, a ranking of ○ indicates the developer is desirable, and a ranking of X indicates the developer is unusable in practice.

Evaluation results are shown in Table 2.

TABLE 2

| | Wax | Post-process Agent | | | | | Wear |
|---|---|---|---|---|---|---|---|
| | blow-off (μC/g) | pH | Hydro-phobicity | Fog | Spotting | Filming | resist-ance |
| Ex. 11 | −30 | 8.0 | 63 | ○ | ○ | ○ | ○ |
| Ex. 12 | −30 | 8.7 | 73 | Δ | ○ | ○ | ○ |
| Ex. 13 | −30 | 7.5 | 77 | ○ | ○ | Δ | ○ |
| Ex. 14 | −10 | 8.0 | 63 | Δ | ○ | ○ | Δ |
| Ex. 15 | −30 | 8.0 | 63 | Δ | Δ | Δ | ○ |
| Ex. 16 | +50 | 8.0 | 63 | x | Δ | Δ | x |
| Ex. 17 | −30 | 4.5 | 35 | x | Δ | x | ○ |
| Ex. 18 | −30 | 9.4 | 35 | x | x | x | ○ |
| Ex. 19 | −30 | 8.0 | 63 | x | Δ | Δ | ○ |
| Ex. 20 | −30 | 8.0 | 63 | x | x | Δ | ○ |

Production of Silica Microparticles I

Using a henschel mixer, 100 g of silicon dioxide powder (#200; Nippon Aerosil K. K.) produced by a dry method was vigorously mixed as 2.5 g y-aminopropylethoxy silane and 10 g of hexamethyldisilazane were titrated. Thereafter, the content material was heated for 2 hr at 120° C., then heated for 2 hr at 130° C. as nitrogen gas was passed through the system to remove volatile non-essential components. The obtained silicon dioxide powder had a pH of 8.2 and hydrophobicity of 60. This silicon dioxide powder was designated silica microparticles I.

Production of Silica Microparticles J

Using a henschel mixer, 100 g of silicon dioxide powder (#150; Nippon Aerosil K. K.) produced by a dry method was vigorously mixed as 10 g of hexamethyldisilazane was titrated. Thereafter, the content material was heated for 2 hr at 120° C., then heated for 2 hr at 130° C. as nitrogen gas was passed through the system to remove volatile non-essential components. The obtained silicon dioxide powder had a pH of 7.1 and hydrophobicity of 75. This silicon dioxide powder was designated silica microparticles J.

Production of Silica Microparticles K

Using a henschel mixer, 100 g of silicon dioxide powder (#200; Nippon Aerosil K. K.) produced by a dry method was vigorously mixed as 10 g of dimethylpolysiloxane was titrated. Thereafter, the content material was heated for 2 hr at 120° C., then heated for 2 hr at 130° C. as nitrogen gas was passed through the system to remove volatile non-essential components. The obtained silicon dioxide powder had a pH of 6.5 and hydrophobicity of 75. This silicon dioxide powder was designated silica microparticles K.

Production of Silica Microparticles L

Using a henschel mixer, 100 g of silicon dioxide powder (#200; Nippon Aerosil K. K.) produced by a dry method was vigorously mixed as 10 g of octyltrimethoxy silane was titrated. Thereafter, the content material was heated for 2 hr at 120° C., then heated for 2 hr at 130° C. as nitrogen gas was passed through the system to remove volatile non-essential components. The obtained silicon dioxide powder had a pH of 4.5 and hydrophobicity of 50. This silicon dioxide powder was designated silica microparticles L.

The pH values of silica microparticles I~L are values measured by pH meter when 4 parts-by-weight of the silica microparticle samples are suspended in 100 ml of 20% methanol-water solution.

Experimental Example 21

| | Parts-by-weight |
|---|---|
| * Thermoplastic styrene-acrylic type resin (copolymerization ratio: styrene/butyl acrylate/butyl methacrylate/methacrylic acid = 7/1.4/1.4/0.2; acid value 6.5 KOH mg/g; number-average molecular weight = 5,000) | 50 |
| * Thermoplastic styrene-acrylic type resin (copolymerization ratio: styrene/butyl acrylate/butyl methacrylate/methacrylic acid = 6/1.9/1.9/0.2; acid value 6.5 KOH mg/g; number-average molecular weight = 200,000) | 50 |
| * Colorant (Carbon black; Mogul L; pH 3.0; Cabot Ltd.) | 10 |
| * Nigrosine pigment (Nigrosine base EX; Oriental Chemical K.K.) | 5 |
| * Polypropylene wax (Biscol 660P; Sanyo Kasei K.K.) | 5 |

These materials were mixed using a henschel mixer, then kneaded using a dual-shaft extrusion kneader. After cooling, the obtained kneaded material was coarsely pulverized by a feather mill, finely pulverized by a jet mill, and classified to obtain color resin particles having a mean particle size of 10 μm.

To these color resin particles was added 0.1 percent-by-weight silica microparticles I, and the materials were mixed using a henschel mixer to obtain developer 21.

Experimental Example 22

Developer 22 was obtained in the same manner as experimental example 21 with the exception that carbon black (MA-8; pH 2.5; Mitsubishi Kasei K. K.) was used as the colorant.

Experimental Example 23

Developer 23 was produced in the same manner as experimental example 21 with the exception that silica microparticles J (pH 7.1, hydrophobicity 75) were substituted for silica microparticles I.

Experimental Example 24

Developer 24 was produced in the same manner as experimental example 21 with the exception that silica microparticles K (pH 6.5, hydrophobicity 75) were substituted for silica microparticles I.

Experimental Example 25

Developer 25 was produced in the same manner as experimental example 21 with the exception that the binder resin comprising 40 parts-by-weight thermoplastic styrene-acrylic resin having a number-average molecular weight of 15,000 (copolymerization ratio: styrene/butyl acrylate/butyl methacrylate/methacrylic acid=7/1.4/1.4/0.2, acid value 6.5 KOHmg/g) and 60 parts-by-weight thermoplastic styrene-acrylic type resin having a number-average molecular weight of 350,000 (copolymerization ratio: styrene/butyl acrylate/butyl methacrylate/methacrylic acid=6/1.9/1.9/0.2, acid value 6.5 KOHmg/g) was substituted for the binder resin of experimental example 21.

Experimental Example 26

Developer 26 was produced in the same manner as experimental example 21 with the exception that the binder resin comprising 60 parts-by-weight thermoplastic styrene-acrylic resin having a number-average molecular weight of 10,000 (copolymerization ratio: styrene/butyl acrylate/ butyl methacrylate/methacrylic acid=7/1.4/1.4/0.2, acid value 6.5 KOHmg/g) and 40 parts-by-weight thermoplastic styrene-acrylic type resin having a number-average molecular weight of 250,000 (copolymerization ratio: styrene/butyl acrylate/butyl methacrylate/methacrylic acid=6/1.9/1.9/0.2, acid value 6.5 KOHmg/g) was substituted for the binder resin of experimental example 21, and silica microparticles J were substituted for silica microparticles I.

Experimental Example 27

Developer 27 was produced in the same manner as experimental example 21 with the exception that the binder resin comprising 50 parts-by-weight thermoplastic styrene-acrylic resin having a number-average molecular weight of 5,000 and acid value of zero (copolymerization ratio: styrene/butyl acrylate/butyl methacrylate=7/1.5/1.5) and 50 parts-by-weight thermoplastic styrene-acrylic type resin having a number-average molecular weight of 200,000 and acid value of zero (copolymerization ratio: styrene/butyl acrylate/butyl methacrylate=6/2/2) were substituted for the binder resin of experimental example 21.

Reference Example 28

Developer 28 was produced in the same manner as experimental example 21 with the exception that silica microparticles L ( pH 4.5, hydrophobicity 50) were substituted for silica microparticles I.

Experimental Example 29

Developer 29 was produced in the same manner as experimental example 27 with the exception that kitchen black (EC-DJ600; pH 9.5, Lion aguzo K. K.) was used as the colorant.

Experimental Example 30

Developer 30 was produced in the same manner as experimental example 27 with the exception that carbon black (Regal 330R, pH 8.5; Cabot Ltd.) was used as the colorant.

Experimental Example 31

Developer 31 was produced in the same manner as experimental example 27 with the exception that carbon black (#25B, pH 6.3, Mitsubishi Kasei K. K.) was used as the colorant.

Experimental Example 32

Developer 32 was produced in the same manner as experimental example 29 with the exception that the binder resin comprising 80 parts-by-weight thermoplastic styrene-acrylic type resin having a number-average molecular weight of 5,000 (copolymerization ratio: styrene/butyl acrylate/butyl methacrylate=7/1.5/1.5, acid value zero) and 20 parts-by-weight thermoplastic styrene-acrylic type resin having a number-average molecular weight of 250,000 (copolymerization ratio: styrene/butyl acrylate/butyl methacrylate=6/2/2, acid value zero) was substituted for the binder resin of experimental example 29.

In the experimental examples 21~32, the number-average molecular weight is expressed as the molecular weight at a position having a peak in a molecular weight distribution measured by gel permeation chromatography (GPC).

Evaluations (1) Fog

These developers were stored for 24 hr at 500° C., then used to print 50,000 sheets using a model EP9765 copying machine (Minolta Co., Ltd.). After 50,000 printings, the copy images were visually evaluated for fog. The evaluation standard are identical to those previously mentioned.

(2) Initial Spotting by Black Dots

The aforesaid developers and experimental examples were evaluated for black dot spotting in the same manner as previously described with the exception that said developers were loaded directly in the copying machine.

(3) Filming

When fogging evaluation was completed, the surface condition of the photosensitive member after 50,000 copied were made was evaluated for filming in the same manner was previously described.

The results of these evaluations are shown in Table 3.

TABLE 3

| | Silica | Carbon black pH | Silica pH | Fog | Initial spotting | Filming |
|---|---|---|---|---|---|---|
| Ex. 21 | I | 3 | 8.2 | ○ | ○ | ○ |
| Ex. 22 | I | 2.5 | 8.2 | ○ | ○ | ○ |
| Ex. 23 | J | 3 | 7.1 | ○ | Δ | ○ |
| Ex. 24 | K | 3 | 6.5 | Δ | Δ | ○ |
| Ex. 25 | I | 3 | 8.2 | ○ | ○ | ○ |
| Ex. 26 | J | 3 | 7.1 | ○ | Δ | ○ |
| Ex. 27 | I | 3 | 8.2 | ○ | Δ | Δ |
| Ex. 28 | L | 3 | 4.5 | x | x | x |
| Ex. 29 | I | 9.5 | 8.2 | x | x | x |
| Ex. 30 | I | 8.5 | 8.2 | x | x | x |
| Ex. 31 | I | 6.3 | 8.2 | Δ | x | Δ |
| Ex. 32 | I | 9.5 | 8.2 | x | x | x |

In above-mentioned evaluations of the developer 1~32 using copying machines EP9765 or EP8605, a developer prepared by mixing each developer samble with carrier particles so as to adjust toner concentoration to about 5 percent-by-weight relative to the developer containing carrier particles.

Although the present invention has been fully described by way of examples with reference to the accompanying drawing, it is to be noted that various changes and modifications will be apparent to those skilled in the art.

Therefore, unless otherwise such changes and modifications depart from the scope of the present invention, they should be construed as being included therein.

What is claimed is:

1. A developer for developing an electrostatic latent image comprising:

(a) a positively chargeable tone particle comprising a binder resin which comprises a copolymer having an acid value of 1 to 10 KOHmg/g and a colorant said copolymer produced with a first monomer, a second monomer and a third monomer, said first monomer being at least one monomer selected from the group consisting of a styrene monomer and styrene derivative monomer, said second monomer being at least one monomer selected from the group consisting of alkyl acrylates and alkyl methacrylates, and said third monomer being an unsaturated carboxylic acid; and (b) a hydrophobic silica adhered to the surface of said toner particle, said hydrophobic silica being treated by a hydrophobic property imparting agent, having a hydrophobicity of 55 or more and having a pH of 7.0 to 9.0.

2. The developer as claimed in claim 1, wherein the acid value of said copolymer is in the range of 3 to 10 KOHmg/g.

3. The developer as claimed in claim 1, wherein the pH of said hydrophobic silica is in the range of 7.5 to 8.5.

4. The developer as claimed in claim 1, wherein said toner particle further comprises a positive charge controlling agent.

5. The developer as claimed in claim 1, wherein said hydrophobic property imparting agent is made of an organosilicic compound.

6. The developer as claimed in claim 1, wherein said hydrophobic silica is further treated by an amino containing surface treatment agent.

7. The developer as claimed in claim 6, wherein said amino containing surface treatment agent is an amino silane coupling agent.

8. The developer as claimed in claim 6, wherein said amino containing surface treatment agent is an aminosilicone oil.

9. The developer as claimed in claim 1, wherein said hydrophobic silica has the hydrophobicity of 55 to 85.

10. The developer as claimed in claim 1, wherein said hydrophobic silica is added in an amount of 0.05 to 0.3 parts by weight per 100 parts by weight of the toner.

11. A developer for developing an electrostatic latent image comprising:

(a) a positively chargeable toner particle comprising a binder resin comprising a first polymer having a number average molecular weight of 2,000 to 20,000 and a second polymer having a number average molecular weight of 50,000 to 500,000, a colorant and a negatively chargeable polyolefm having a charge amount of −30 to −10 μC/g measured by blow-off method, said polyolefin contained in an amount of 0.5 to 5.0 parts by weight per 100 parts by weight of the binder resin, said first and second polymer each being contained in an amount of 30 to 70 percent by weight on the basis of the binder resin, said first and second polymer respectively comprising a copolymer produced with a first monomer and a second monomer, said first monomer being at least one monomer selected from the group consisting of a styrene monomer and styrene derivative monomer, said second monomer being at least one monomer selected from the group consisting of an acrvlate monomer and methacrvlate monomer; and (b) a hydrophobic silica adhered to the surface of said toner particle, said hydrophobic silica being treated by a hydrophobic property imparting agent, having a hvdrophobicity of 55 or more and having a pH of 7.0 to 9.0.

12. The developer as claimed in claim 11, wherein the amount of said first and second polymer is in the range of 40 to 60 percent by weight on the bAsis of the toner.

13. The developer as claimed in claim 11, wherein the pH of said hydrophobic silica is in the range of 7.5 to 8.5.

14. The developer as claimed in claim 11, wherein said hydrophobic silica is further treated by an amino containing coupling agent.

15. The developer as claimed in claim 11, wherein said hydrophobic silica has a hydrophobicity of 55 to 85.

16. The developer as claimed in claim 11, wherein said hydrophobic silica is added in an amount of 0.05 to 0.3 parts by weight per 100 parts by weight of the toner.

17. A developer for developing an electrostatic latent image comprising:

(a) a positively chargeable toner particle comprising a binder resin comprising a first polymer having a number average molecular weight of 2,000 to 20,000 and a second polymer having a number average molecular weight of 50,000 to 500,000, said first and second polymer each being contained in an amount of 30 to 70 percent by weight on the basis of the binder resin and a carbon black having pH of 2.0 to 5.0 as a colorants, said carbon black contained in an amount of 7 to 15 parts by weight per 100 parts by weight of the binder resin, said first and second polymer respectively comprising a copolymer produced with a first monomer and a second monomer, said first monomer being at least one monomer selected from the group consisting of a styrene monomer and styrene derivative monomer, said second monomer being at least one monomer selected from the group consisting of an acrylate monomer and methacrylate monomer; and (b) a hydrophobic silica adhered to the surface of said toner particle, said hydrophobic silica being treated by a hydrophobic property imparting agent, having a hydrophobicity of 55 or more and having a pH of 7.0 to 9.0.

18. The developer as claimed in claim 17, wherein the amount of said first and second polymer is in the range of 40 to 60 percent by weight on the basis of the toner.

19. The developer as claimed in claim 17, wherein the pH of said carbon black is in the range of 2 to 3.

20. The developer as claimed in claim 17, wherein said carbon black is contained in an amount of 10 to 15 parts by weight per 100 parts by weight of the binder resin.

21. The developer as claimed in claim 17, wherein the pH of said hydrophobic silica is in the range of 7.5 to 8.5.

22. The developer as claimed in claim 17, wherein said hydrophobic silica is further treated by an amino containing coupling agent.

23. The developer as claimed in claim 17, wherein said hydrophobic silica has the hydrophobicity of 55 to 85.

24. The developer as claimed in claim 17, wherein said hydrophobic silica is added in an amount of 0.05 to 0.3 parts by weights per 100 parts by weight of the toner.

25. A developer for developing an electrostatic latent image comprising;

(a) a positively chargeable toner particle comprising a colorant, and a binder resin comprising a first and second polymer having peaks in a molecular weight distribution measured by gel permeation chromatography, wherein a first peak is in the range of 2,000 to 20,000 and a second peak is in the range of 50,000 to 500,000, wherein said first and second polymer respectively comprises a copolymer produced with a first monomer and a second monomer, said first monomer being at least one monomer selected from the group consisting of a styrene monomer and styrene derivative monomer, and said second monomer being at least one monomer selected from the group consisting of an acrylate monomer and methacrylate monomer, and wherein said toner particle further comprises a polyolefin having a charge amount of −30 to −10 μC/g, said polyolefin contained in an amount of 0.5 to 5.0 parts by weight per 100 parts by weight of the binder resin; and (b) a hydrophobic silica adhered to the surface of the toner particle, said hydrophobic silica being treated by a hydrophobic property imparting agent, having a hydrophobicity of 55 or more and having a pH of 7.0 to 9.0.

26. The developer as claimed in claim, 25, wherein said copolymer is produced with said first monomer, an unsaturated carboxylic acid and said second monomer.

27. The developer as claimed in claim, 25, wherein the acid value of said copolymer is in the range of 1 to 10 KOHmg/g.

28. The developer as claimed in claim 25, wherein the charge amount of said polyolefin is measured by blow-off imethod.

29. The developer as claimed in claim 25, wherein said hydrophobic silica hap the hydrophobicity of 55 to 85.

30. The developer as claimed in claim 25, which further comprises a carrier to be used as a two-component developer.

31. A developer for developing an electrostatic latent image comprising:

(a) a positively chargeable toner particle comprising a colorant, and a binder resin comprising a first and second polymer having peaks in a molecular weight distribution measured by gel permeation chromatography, wherein a first peak is in the range of 2,000 to 20,000 and a second peak is in the range of 50,000 to 500,000, wherein said first and second polymer respectively comprises a copolymer produced with a first monomer and a second monomer, said first monomer being at least one monomer selected from the group consisting of a styrene monomer and styrene derivative monomer, said second monomer being at least one monomer selected from the group consisting of an acrylate monomer and methacrylate monomer, and wherein said colorant is made of a carbon black having a pH of 2.0 to 5.0 and contained in an amount of 7 to 15 parts by weight per 100 parts by weight of the binder resin; and (b) a hydrophobic silica adhered to the surface of the toner particle, said hydrophobic silica being treated by a hydrophobic property imparting agent, having a hydrophobicity of 55 or more and having a pH of 7.0 to 9.0.

32. The developer as claimed in claim 31, wherein said copolymer is produced with said first monomer, an unsaturated carboxylic acid and said second monomer.

33. The developer as claimed in claim 31, wherein the acid value of said copolymer is in the range of 1 to 10 KOHmg/g.

34. The developer as claimed in claim 31, wherein the charge amount of said polyolefin is measured by blow-off method.

35. The developer as claimed in claim 31, wherein said hydrophobic silica has the hydrophobicity of 55 to 85.

36. The developer as claimed in claim 31, which further comprises a carrier to be used as a two-component developer.

* * * * *

UNITED STATES PATENT AND TRADEMARK OFFICE

CERTIFICATE OF CORRECTION

PATENT NO. : 5,789,131

DATED : August 4, 1998

INVENTOR(S) : MIKURIYA et al.

It is certified that error appears in the above-identified patent and that said Letters Patent is hereby corrected as shown below:

Col. 19, l. 41: Change "polyolefm" to --polyolefin--;

Col. 19, l. 53: Change "acrvlate" to --acrylate--;

Col. 19, l. 54: Change "methacrvlate" to --methacrylate--;

Col. 19, l. 58: Change "hvdrophobicity" to --hydrophobicity--;

Col. 19, l. 62: Change "bAsis" to --basis--;

Col. 20, l. 15: Change "colorants" to --colorant--;

Col. 20, l. 48: Change "weights" to --weight--;

Col. 21, l. 18: Change "imethod" to --method--;

Col. 21, l. 20: Change "hap" to --has--.

Signed and Sealed this

Twelfth Day of October, 1999

*Attest:*

Q. TODD DICKINSON

*Attesting Officer*

*Acting Commissioner of Patents and Trademarks*